US007582135B2

(12) United States Patent
Nakamura et al.

(10) Patent No.: US 7,582,135 B2
(45) Date of Patent: Sep. 1, 2009

(54) PROCESS FOR PRODUCING ULTRAFINE PARTICLES

(75) Inventors: Keitaroh Nakamura, Saitama (JP); Takashi Fujii, Saitama (JP)

(73) Assignees: Nisshin Seifun Group Inc., Tokyo (JP); Nisshin Engineering Inc., Tokyo (JP)

( * ) Notice: Subject to any disclaimer, the term of this patent is extended or adjusted under 35 U.S.C. 154(b) by 198 days.

(21) Appl. No.: 11/580,877

(22) Filed: Oct. 16, 2006

(65) Prior Publication Data

US 2007/0084308 A1 Apr. 19, 2007

(30) Foreign Application Priority Data

Oct. 17, 2005 (JP) ..... 2005-302281

(51) Int. Cl.
*B22F 9/14* (2006.01)

(52) U.S. Cl. ..... 75/346; 264/483; 977/895

(58) Field of Classification Search ..... 75/346; 264/483

See application file for complete search history.

(56) References Cited

U.S. PATENT DOCUMENTS 6,582,763 B1 6/2003 Nishimura et al.
2003/0143153 A1* 7/2003 Boulos et al. ..... 423/592.1
2006/0051505 A1* 3/2006 Kortshagen et al. ..... 427/212

FOREIGN PATENT DOCUMENTS

JP 5-43791 7/1993
JP 2000-219901 8/2000

* cited by examiner

*Primary Examiner*—George Wyszomierski
(74) *Attorney, Agent, or Firm*—Young & Thompson

(57) ABSTRACT

The ultrafine particle producing process introduces materials for producing ultrafine particles into a thermal plasma flame under reduced pressure to form a vapor-phase mixture, introduces a reactive gas and a cooling gas toward an end portion of the thermal plasma flame in supply amounts sufficient for quenching the vapor-phase mixture to generate the ultrafine particles and allows the resultant ultrafine particles to come into contact with the reactive gas so as to produce the ultrafine particles whose surfaces are coated with a thin film including one or more components compound derived from decomposition and/or reaction of the reactive gas, for example, an elementary carbon substance and/or a carbon. According to the process, thin film-coated ultrafine particles having high level uniformity in particle size and shape can be produced.

12 Claims, 11 Drawing Sheets

PROCESS FOR PRODUCING ULTRAFINE PARTICLES

The entire contents of the documents cited in this specification are herein incorporated by reference.

BACKGROUND OF THE INVENTION

The present invention relates to a process for producing ultrafine particles each coated with a thin film, and more particularly, to a process for producing ultrafine particles, each having a thin film including an elementary carbon substance and/or a carbon compound formed thereon, using a thermal plasma method.

Fine particles such as oxide fine particles, nitride fine particles, and carbide fine particles have been used in the production of sintered bodies, for example, electrical insulating materials for semiconductor substrates, printed wiring boards, and various electrically insulating parts, materials for high-hardness and high-precision machining tools such as dies and bearings, functional materials for grain boundary capacitors, humidity sensors and the like, or precision sinter molding materials, and in the production of thermal sprayed parts, for example, engine valves, of materials that are required to be wear-resistant at a high temperature, as well as in the fields of electrodes, electrolytic materials, and various catalysts for fuel cells. Use of such fine particles improves bonding strengths between different ceramics or different metals in a sintered body or thermal sprayed part, or denseness or functionality thereof.

One of the methods for producing such fine particles is a vapor-phase method. The vapor-phase method includes a chemical method that involves chemically reacting various gases or the like at high temperatures and a physical method that involves applying an electron beam or laser beam to substances to decompose or evaporate the substances so as to form fine particles.

An example of the vapor-phase method is a thermal plasma method. The thermal plasma method is a method of producing fine particles by instantaneously evaporating a raw material in thermal plasma and then quenching and condensing/solidifying the evaporated material to produce fine particles. This method has many advantages such as high cleanness, high productivity, applicability to high melting point materials because of high heat capacity at high temperatures, and easy preparation of composite material particles as compared with other vapor-phase methods. Therefore, the thermal plasma method is often used as a method of producing fine particles.

With regard to the introduction of a powdered material into a thermal plasma flame, JP 2000-219901 A (hereinafter referred to as Patent Document 1) describes a method of producing oxide coated fine metal particles, involving combining fine metal particles with a powdery raw material for a coating layer, supplying the resultant material mixture into a thermal plasma (i.e., thermal plasma flame) of an inert or reducing atmosphere to evaporate the materials to obtain a vapor-phase mixture, and then quenching the vapor-phase mixture.

Recently, it has been increasingly required that the above-mentioned various fine particles should have smaller sizes regardless of their material.

This is because a target for which the fine particles are used is required to be of a smaller size. Here, there arises a problem in that the smaller the size of the fine particles becomes, the higher the surface activity becomes, which conversely decreases the stability of the fine particles.

For example, when metals such as iron and copper are converted into fine particles, it is well known that slowly oxidizing fine particles each having a size on the order of several micrometers (μm) result in formation of an oxide film thereon. However, in a case of fine particles each having a size on the order of few nanometers (nm) to several tens nanometers (nm) (hereinafter, referred to as "ultrafine particles" in order to distinguish them from the conventionally used "fine particles" designated based on sensory distinction), oxidation occurs abruptly which may even be dangerous.

Further, when a low melting point metal such as gold and silver is formed into fine particles, it is known that the melting point of the metal decreases abruptly when the particle size is on the order of a few nanometers (nm). The particles would readily be coalesced together even when the particle size is on the order of several tens nanometers (nm), and it becomes difficult to obtain ultrafine particles that are independent of each other.

One of the methods for producing such the ultrafine particles is proposed in JP 05-043791 B (hereinafter, referred to as "Patent Document 2").

The technique described in Patent Document 2 is to perform vacuum deposition in the presence of a reactive gas to form carbon atom layers of a uniform thickness (i.e., an ultrafine layer on the order of few atoms to several tens atoms) on the surfaces of ultrafine powder particles (as cores).

SUMMARY OF THE INVENTION

The method of producing "ultrafine powder whose particles are coated with a carbon ultrathin film" described in above Patent Document 2 involves feeding the ultrafine powder with a particle size of a few tens nanometers (nm) that has previously been formed into an atmosphere for vapor deposition, and uniformly depositing atomic carbon (i.e., carbon atoms) generated as a result of decomposition and/or reaction of a reactive gas present in the atmosphere onto the surfaces of ultrafine powder particles.

As described before, the smaller the size of the fine particles becomes, the higher the surface activity becomes, which conversely decreases the stability of the fine particles. Accordingly, there is a problem to date in that the ultrafine particles whose surfaces are coated with a thin film and which are useful to various functional materials, precision sinter molding materials, and so forth cannot be produced, and produced with efficiency in particular, by such a consecutive process as involving forming even finer particles with a particle size on the order of a few nanometers, namely ultrafine particles, and coating the surfaces of formed ultrafine particles with a thin film.

The present invention has been made in view of the above-mentioned circumstances, and it is an object of the present invention to obviate the problems as above and provide a process for producing ultrafine particles whose surfaces are coated with a thin film based on consecutive production steps, which process enables to efficiently perform vapor-phase thin film formation on the surfaces of ultrafine particles that are expected to have a high surface activity and novel functionality, and to establish high level uniformity in particle size and shape.

More particularly, it is an object of the present invention to provide a process for producing ultrafine particles each coated with a thin film including an elementary carbon substance and/or a carbon compound.

In view of necessity of establishing a process for stably and efficiently producing the ultrafine particles expected to have high surface activity and novel functionality as above, the inventors of the present invention have made extensive research to attain the above-mentioned objects. As a result, the inventors of the present invention have found that introduction of a reactive gas and a cooling gas toward an end portion of a thermal plasma flame in a cooling chamber that converts materials for producing ultrafine particles into a vapor-phase mixture enables production of ultrafine particles each coated with a thin film composed of reactive gas components on the surface thereof, thus having completed the present invention.

Therefore, the process for producing ultrafine particles each coated with a thin film according to the present invention includes: introducing materials for producing ultrafine particles into a thermal plasma flame under reduced pressure to form a vapor-phase mixture; and introducing a reactive gas and a cooling gas toward an end portion of the thermal plasma flame in supply amounts sufficient for quenching the vapor-phase mixture to generate ultrafine particles and, at the same time, allow the resultant ultrafine particles to come into contact with the reactive gas so as to produce ultrafine particles whose surfaces are coated with a thin film including components derived from decomposition and/or reaction of the reactive gas.

Here, the step of introducing the materials for producing ultrafine particles into the thermal plasma flame preferably includes dispersing the materials for producing ultrafine particles with a carrier gas, and introducing the dispersed materials for producing ultrafine particles into the thermal plasma flame.

It is preferable to control the particle size of the ultrafine particles by changing the supply amount of at least one of the reactive gas, the carrier gas and the cooling gas.

It is also preferable to control a thickness of the thin film to be coated on the surfaces of the ultrafine particles by changing the supply amount of at least one of the reactive gas, the carrier gas and the cooling gas.

Further, the reactive gas is preferably a hydrocarbon gas and the thin film to be coated on the surfaces of the ultrafine particles is preferably a thin film that includes an elementary carbon substance and/or a carbon compound. The carrier gas is preferably an inert gas.

Further, components that constitute the materials for producing ultrafine particles are preferably metals, alloys, simple oxides, composite oxides, double oxides, oxide solid solutions, hydroxides, carbonate compounds, halides, sulfides, nitrides, carbides, hydrides, metal salts, or organometallic compounds that contain at least one element selected from the group consisting of elements having atomic numbers of 12, 13, 26 to 30, 46 to 50, 62, and 78 to 83.

The cooling gas is preferably an inert gas.

Note that in the process for producing ultrafine particles each coated with a thin film according to the present invention, the supply amounts of the reactive gas and the cooling gas sufficient for quenching the vapor-phase mixture are defined as described below. That is, the supply amount of a mixed gas of the reactive gas and the cooling gas is preferably set such that the mixed gas introduced into a cooling chamber comprising a space for quenching the vapor-phase mixture has an average flow rate in the cooling chamber (i.e., intra-chamber flow rate) of 0.001 to 60 m/sec. More preferably, the supply amount of the mixed gas is such that the average flow rate becomes 0.01 to 10 m/sec.

Further, the direction in which the mixed gas is introduced into the cooling chamber is preferably such that: when the vertically upward direction is assumed to give an angle of 0° to an end portion (i.e., tail) of the thermal plasma flame located in the chamber, the direction in which the mixed gas is introduced into the cooling chamber forms an angle $\alpha$ within the range of $90° < \alpha < 240°$ to the end portion; and when the direction as seen from a gas ejection nozzle toward the thermal plasma flame is assumed to give an angle of 0° to the end portion, the direction in which the mixed gas is introduced into the cooling chamber forms an angle $\beta$ within the range of $-90° < \beta < 90°$ to the thermal plasma flame. More preferably, the direction in which the mixed gas is introduced into the cooling chamber is such that the angle $\alpha$ is within the range of $100° < \alpha < 180°$ and the angle $\beta$ is within the range of $-45° < \beta < 45°$.

The present invention has remarkable effects. In other words, according to the present invention, vapor-phase thin film formation on the surfaces of ultrafine particles which are expected to have a high surface activity and a novel functionality can be efficiently performed, and a process for producing ultrafine particles each coated with a thin film, which can realize high level uniformity in particle size and shape, can be obtained.

More specifically, according to the present invention, by introducing materials for producing ultrafine particles into a thermal plasma flame under reduced pressure to form a vapor-phase mixture, introducing a reactive gas and a cooling gas toward an end portion (i.e., tail) of the thermal plasma flame in amounts sufficient for quenching the vapor-phase mixture to generate ultrafine particles, and allowing the resultant ultrafine particles to come into contact with the reactive gas, ultrafine particles each coated with a thin film can be produced in such a manner that the step of efficiently generating ultrafine particles (i.e., cores) and the step of depositing an elementary carbon substance and/or a carbon compound generated as a result of decomposition and/or reaction of the reactive gas onto the surfaces of the resultant ultrafine particles (i.e., cores) are performed at a time.

DETAILED DESCRIPTION OF THE INVENTION

Figure 1:
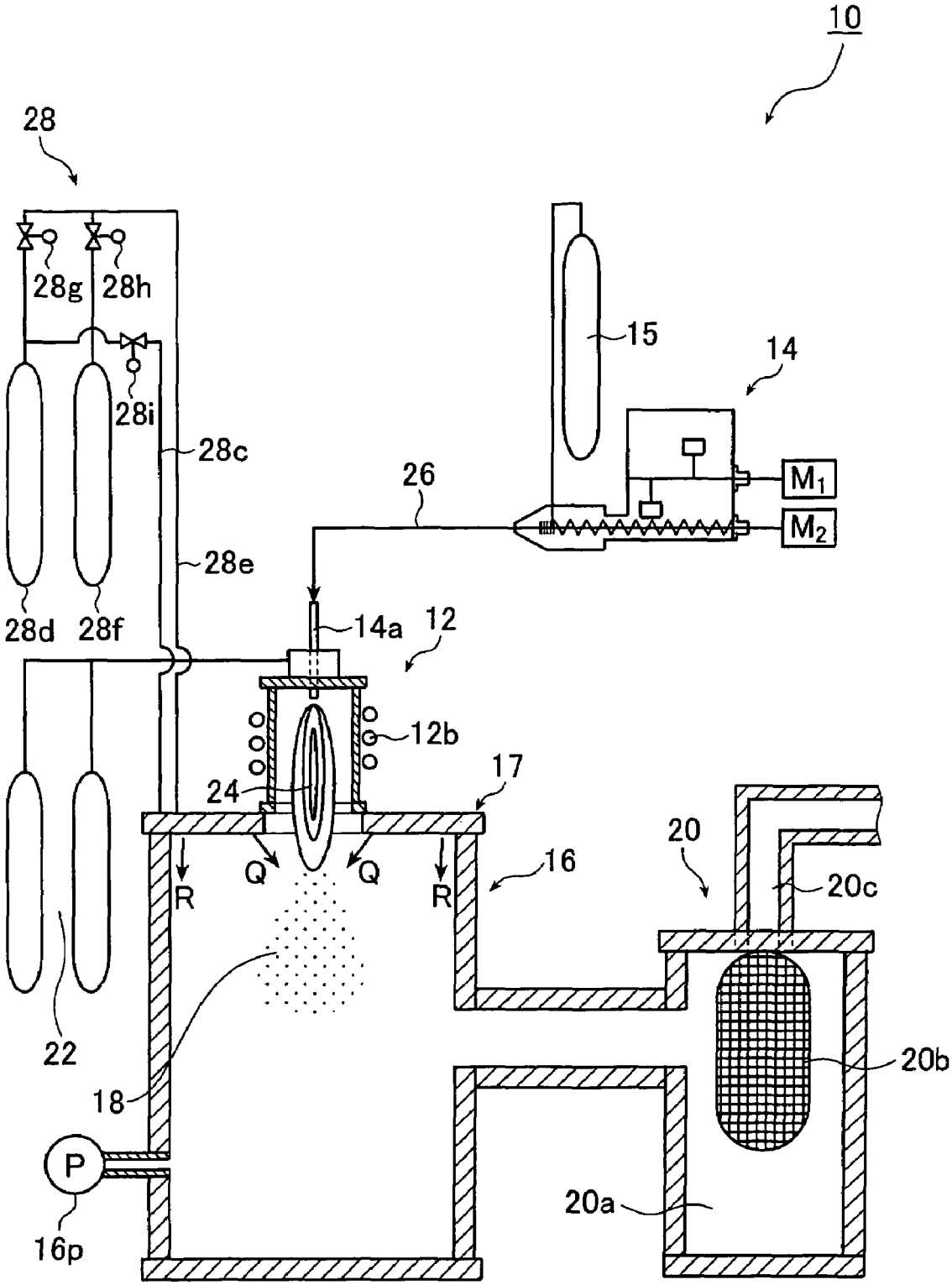
FIG. 1 is a schematic diagram showing the whole construction of an ultrafine particle producing apparatus for practicing a process for producing ultrafine particles according to an embodiment of the present invention.

Hereinafter, the process for producing ultrafine particles according to the present invention will be described in detail based on preferred embodiments shown in the drawings.

Figure 2:
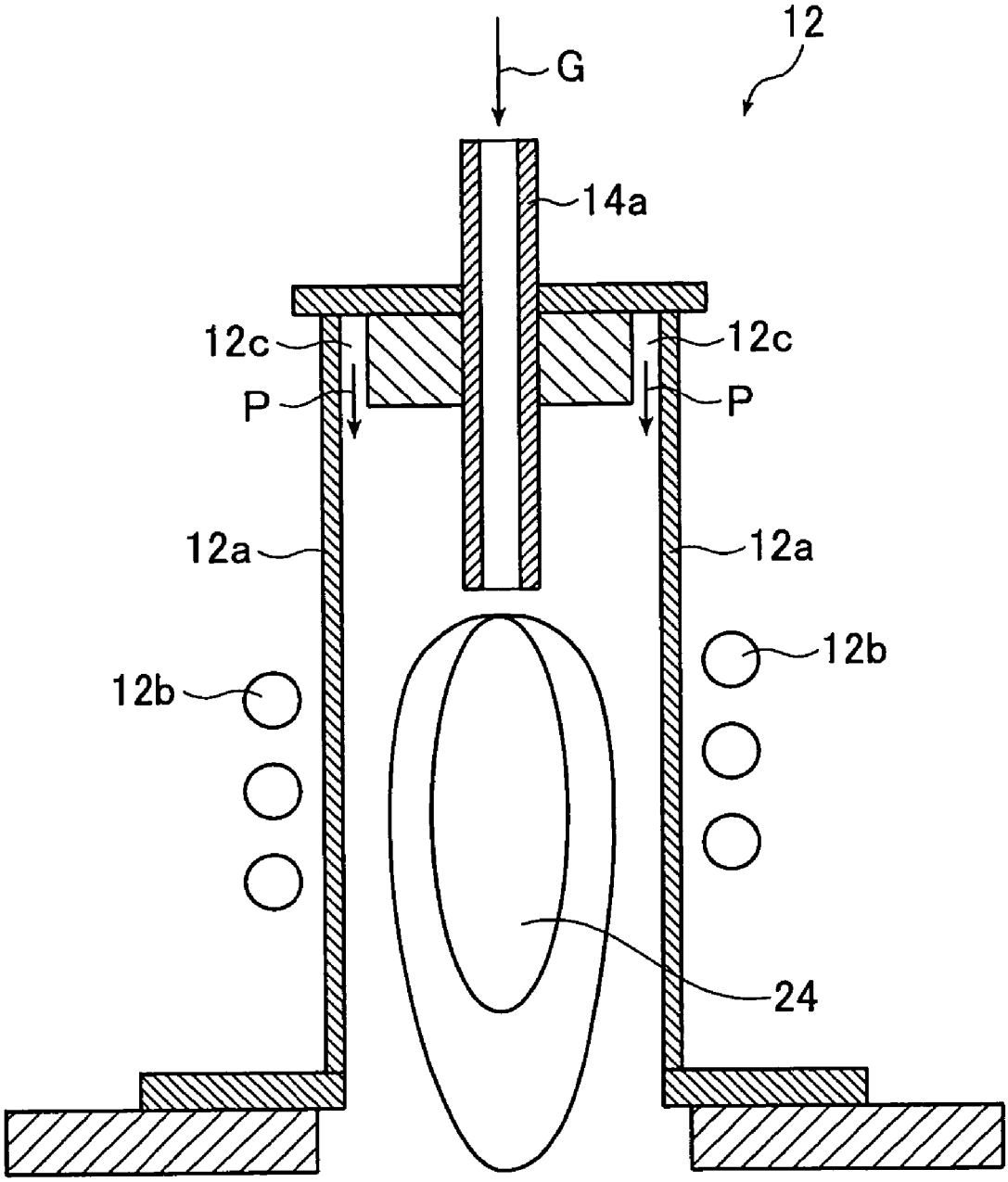
FIG. 2 is a cross-sectional view of a part near a plasma torch of the apparatus shown in FIG. 1.
Figure 3:
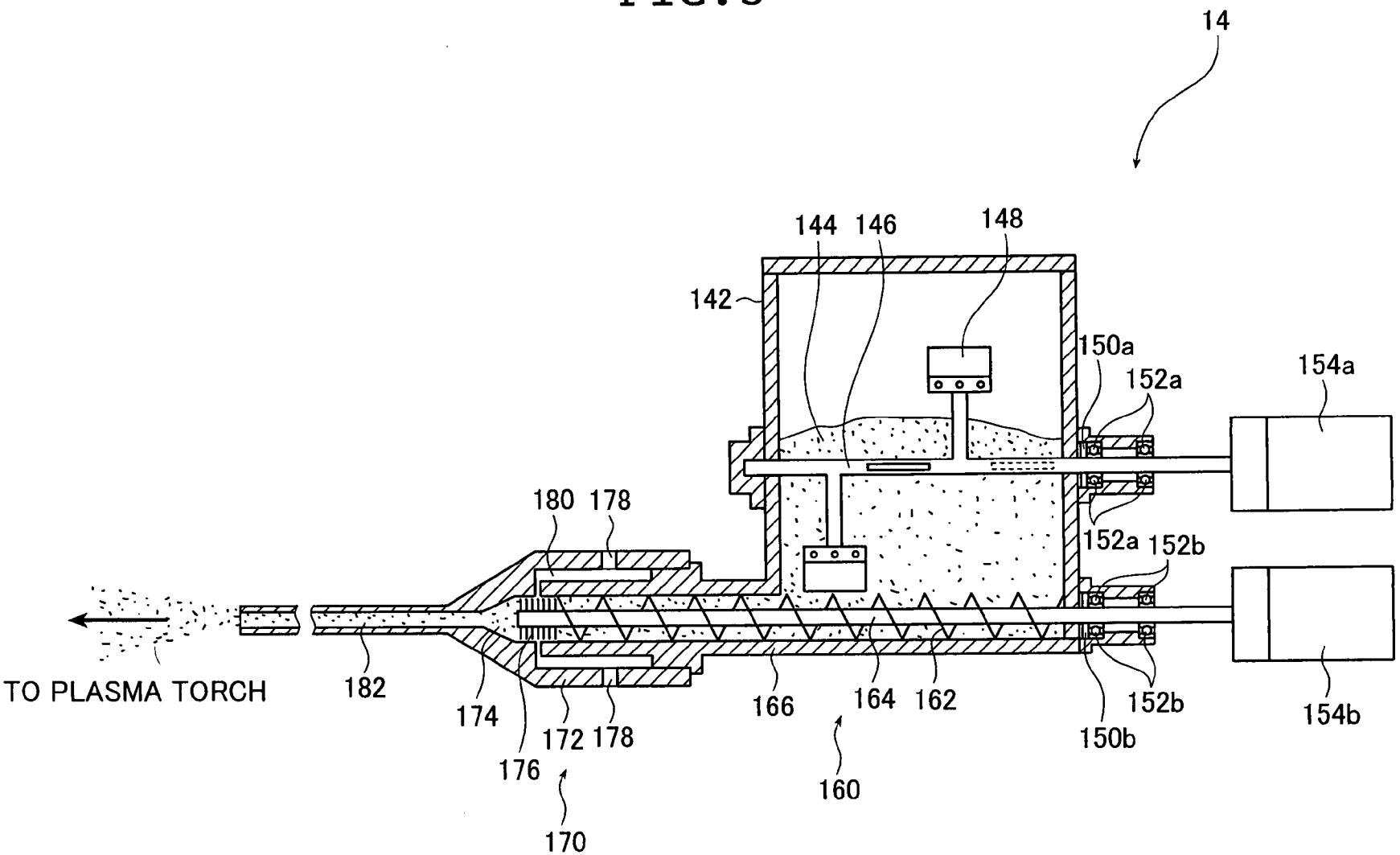
FIG. 3 is a cross-sectional view schematically showing a construction of a powder material supplying apparatus shown in FIG. 1.
Figure 4:
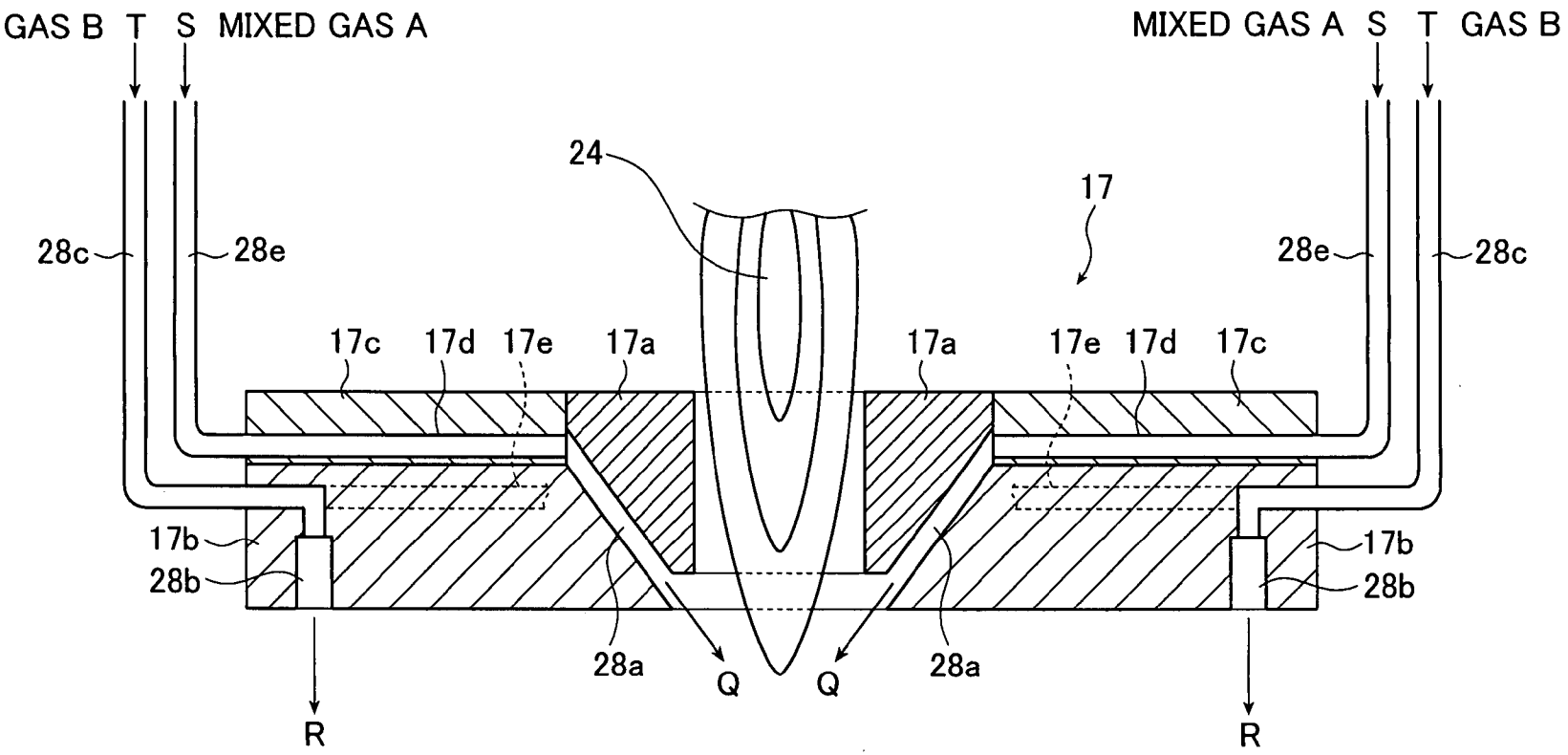
FIG. 4 is an enlarged cross-sectional view showing a top panel of a chamber shown in FIG. 1 and a part near gas ejection nozzles provided in the top panel.

FIG. 1 is a schematic diagram showing the whole construction of an ultrafine particle producing apparatus 10 for practicing a process for producing ultrafine particles each coated with a thin film according to an embodiment of the present invention. FIG. 2 is a partially enlarged diagram showing a part near a plasma torch 12 shown in FIG. 1. FIG. 3 is an enlarged diagram showing a material supplying apparatus 14 shown in FIG. 1. FIG. 4 is an enlarged cross-sectional view showing a top panel 17 of a chamber 16 shown in FIG. 1 and the part near a gas ejection nozzle 28*a* and a gas ejection nozzle 28*b* each provided in the top panel 17.

The ultrafine particle producing apparatus 10 shown in FIG. 1 includes a plasma torch 12 for generating a thermal plasma flame, a material supplying apparatus 14 for supplying a raw material for producing ultrafine particles (hereinafter referred to as "powder material") 144 (see FIG. 3) into the plasma torch 12, a chamber 16 having a function as a cooling chamber for generating ultrafine particles 18, a collecting section 20 for collecting the generated ultrafine particles 18, and a gas introduction apparatus 28 for introducing a mixed gas for cooling containing a reactive gas into the chamber 16 and ejecting the mixed gas toward a thermal plasma flame 24.

The plasma torch 12 shown in FIG. 2 includes a quartz tube 12*a* and a coil 12*b* for high frequency oscillation, which surrounds the outside of the quartz tube. In an upper part of the plasma torch 12, an introduction tube 14*a* described below for introducing the material for producing ultrafine particles and the carrier gas into the plasma torch 12 is provided in the center thereof, and a plasma gas introduction port 12*c* is formed in the periphery thereof (i.e., on the same circle).

The plasma gas is sent from a plasma gas source 22 to the plasma gas introduction port 12*c*. Examples of the plasma gas include argon, nitrogen, and hydrogen. In the plasma gas source 22, for example, two kinds of plasma gases are provided. The plasma gas is sent from the plasma gas source 22 into the plasma torch 12 through the plasma gas introduction port 12*c* in the form of a ring as shown by an arrow P. Then, high frequency current is applied to the coil 12*b* for high frequency oscillation to generate the thermal plasma flame 24.

Note that the outside of the quartz tube 12*a* is surrounded by a tube (not shown) formed concentrically, and cooling water is circulated in a space between this tube and the quartz tube 12*a* to cool the quartz tube 12*a* in order to prevent the quartz tube 12*a* from reaching too high a temperature due to the thermal plasma flame 24 generated in the plasma torch 12.

The material supplying apparatus 14, as shown on an enlarged scale in FIG. 3, includes as main components a storage tank 142 for storing the powder material, a screw feeder 160 for transporting a specified amount of the powder material, and a dispersing section 170 for dispersing the fine particles transported by the screw feeder 160 into a state of primary particles before the particles are finally spread.

The storage tank 142 is provided with exhaust piping and air inlet piping (not shown). The storage tank 142 is a pressure vessel sealed with oil seal or the like, and is constructed so that the atmosphere therein can be controlled. Further, in the upper part of the storage tank 142, an introduction port (not shown) for introducing the powder material is provided, and the powder material 144 is charged into the storage tank 142 through the introduction port and stored therein.

In the storage tank 142, an agitation shaft 146 and an agitation vane 148 connected thereto are provided in order to prevent agglomeration of the powder material 144 stored in the tank 142. The agitation shaft 146 is provided rotatably in the storage tank 142 by means of an oil seal 150*a* and a bearing 152*a*.

Further, an end of the agitation shaft 146 positioned outside the storage tank 142 is connected to a motor 154*a*, and its rotation is controlled by a controlling apparatus (not shown).

In a lower part of the storage tank 142, there is provided the screw feeder 160 for enabling transportation of the powder material 144 in a specified amount. The screw feeder 160 includes as components a screw 162, a shaft 164 of the screw 162, a casing 166, and a motor 154*b* which is a source of rotation power for the screw 162. The screw 162 and the shaft 164 are provided in the lower part of the storage tank 142 so as to run across the storage tank. The shaft 164 is provided rotatably in the storage tank 142 through an oil seal 150*b* and a bearing 152*b*.

Further, an end of the shaft 164 positioned outside the storage tank 142 is connected to a motor 154*b* and its rotation is controlled by a controlling apparatus (not shown). Further, an opening in the lower part of the storage tank 142 and the dispersing section 170 described later are connected with each other by a casing 166 which is a cylindrical passage that accommodates the screw 162. The casing 166 extends in the midway of the inside of the dispersing section 170 described later.

As shown in FIG. 3, the dispersing section 170 has an outer tube 172 fitted onto a part of the casing 166 and secured thereto and a rotary brush 176 whose bristles are set in a front edge of the shaft 164, so the powder material 144 transported in a specified amount by the screw feeder 160 can be dispersed primarily.

The end of the outer tube 172 opposite with that fitted onto the casing 166 and secured thereto is frusto-conical in shape, and constitutes a powder dispersing chamber 174 whose interior is also frusto-conical. Further, this end is connected with a transporting tube 182 for transporting the powder material dispersed in the dispersing section 170.

The front edge of the casing 166 is opened and the shaft 164 extends beyond the opening to the powder dispersing chamber 174 inside the outer tube 172, and the rotary brush 176 is provided on the front edge of the shaft 164. A side wall of the outer tube 172 is provided with carrier gas supply ports 178, and a space defined by an outer wall of the casing 166 and an inner wall of the outer tube 172 functions as a carrier gas passage 180 through which the introduced carrier gas passes.

The rotary brush 176 is an assembly of needle-like members made of a relatively flexible material such as nylon, or a hard material such as a steel wire. The needle-like members, namely bristles, are arranged densely so as to extend radially outwardly of the shaft 164 along the inside of the casing 166 from near the front edge thereof to the inside of the powder dispersing chamber 174. The length of a needle-like member is such that the tip of the needle-like member abuts the inner wall of the casing 166.

In the dispersing section 170, a gas for dispersion and transportation is ejected from a carrier gas source 15 through the carrier gas supply ports 178 and the carrier gas passage 180 to the rotary brush 176 from the outside of the rotary brush 176 in the radial direction. As a result, the powder material 144 transported in a specified amount is dispersed into primary particles by passing through the needle-like members of the rotary brush 176.

Here, the powder dispersing chamber 174 is formed such that the angle between the generatrix of the frusto-conical powder dispersing chamber 174 and the shaft 164 is about 30°. An inner volume of the powder dispersing chamber 174 is preferably small. If the inner volume of the powder dispersing chamber is large, the powder material 144 dispersed by the rotary brush 176 adheres to the inner wall of the powder dispersing chamber before the powder material 144 enters the transporting tube 182, which is then scattered again, thus causing a problem in that the density of the dispersed powder to be supplied is not made uniform.

The transporting tube 182 is connected to the outer tube 172 at one end thereof and to the plasma torch 12 at the other end. Further, the transporting tube 182 has a length ten or more times as large as the diameter thereof and is preferably provided at least in the midway with a portion having a diameter which allows the gas stream containing the dispersed powder to flow in a flow rate of 20 m/sec or more. This can prevent agglomeration of the powder material 144 that has been dispersed into a state of primary particles in the dispersing section 170, and allows the powder material 144 to be spread in the plasma torch 12 while keeping the above-mentioned dispersion state.

The carrier gas under extrusion pressure is supplied from the carrier gas source 15 together with the powder material 144 through the introduction tube 14*a* into the thermal plasma flame 24 in the plasma torch 12 as indicated by an arrow G shown in FIG. 2. The introduction tube 14*a* has a nozzle mechanism for spraying the powder material into the thermal plasma flame 24 in the plasma torch 12, and the powder material 144 is sprayed into the thermal plasma flame 24 in the plasma torch 12 through the nozzle mechanism. As the carrier gas, argon, nitrogen, hydrogen, and the like can be used alone or in combination as appropriate.

On the other hand, as shown in FIG. 1, the chamber 16 is provided below and adjacent to the plasma torch 12. The powder material 144 sprayed into the thermal plasma flame 24 in the plasma torch 12 is evaporated to form a vapor-phase mixture, and immediately thereafter, the vapor-phase mixture is quenched in the chamber 16 to generate ultrafine particles 18. That is, the chamber 16 has both functions of a cooling chamber and a reaction chamber.

By the way, the ultrafine particle producing apparatus of the present invention is characterized by being provided with a gas introduction apparatus mainly provided for quenching the vapor-phase mixture. Hereinafter, the gas introduction apparatus is explained.

The gas introduction apparatus 28 shown in FIGS. 1 and 4 includes a first gas source 28*d* and a second gas source 28*f* as well as pipes 28*c* and 28*e* connecting the first gas source 28*d* and the second gas source 28*f*.

Here, the first gas source 28*d* stores argon as a cooling gas and the second gas source 28*f* stores methane as a reactive gas.

Note that examples of the cooling gas used in the present invention include, in addition to argon, such gases as nitrogen, hydrogen, oxygen, air, carbon dioxide, water vapor, gaseous hydrocarbon such as methane, and a mixture thereof.

Further, the gas introduction apparatus 28 is provided with a gas ejection nozzle 28*a* for ejecting a mixed gas A (here, as an example, a mixed gas of argon as the cooling gas and methane as the reactive gas) at the predetermined angle as described above toward the tail of the thermal plasma flame 24, and with a gas ejection nozzle 28*b* for ejecting a gas B (here, argon as one example) from above to below along the inner side wall of the chamber 16 in order to prevent the ultrafine particles 18 generated in the chamber 16 from adhering to the inside of the chamber 16.

Here, the tail of the thermal plasma flame refers to an edge of the thermal plasma flame on the side opposite with the plasma gas introduction port 12*c*, that is, an end portion of the thermal plasma flame.

Note that in FIG. 1, reference symbols 28*g* and 28*i* indicate pressure control valves for controlling gas supply pressures from the first gas source 28*d*, while reference symbol 28*h* indicates a pressure control valve for controlling a gas supply pressure from the second gas source 28*f*. Further, the pipe 28*e* is to mix gases sent from the first gas source 28*d* and the second gas source 28*f* after adjustment of the pressures thereof and send the mixed gas into the chamber 16. The pipe 28*c* is to send the gas from the first gas source 28*d* directly to the chamber 16.

As shown in FIG. 4, the gas ejection nozzles 28*a* and 28*b* are formed in the top panel 17 of the chamber 16. The top panel 17 includes an inner top panel part 17*a* having a frusto-conical shape with an upper portion thereof being a cylinder, a lower top panel part 17*b* having a frusto-conical hole, and an upper outer top panel part 17*c* having a moving mechanism for vertically moving the inner top panel part 17*a*.

Here, a portion in which the inner top panel part 17*a* and the upper outer top panel part 17*c* come into contact with each other (i.e., the cylinder portion in the upper portion of the inner top panel part 17*a* ) is threaded, so the position of the inner top panel part 17*a* can be changed in the vertical direction by rotating the inner top panel part 17*a*, and the inner top panel part 17*a* can be adjusted for its distance from the lower top panel part 17*b*. Further, a slope of the conical portion of the inner top panel part 17*a* is the same as a slope of the conical portion of the hole of the lower top panel part 17*b*, which means that they are constructed such that they can be combined with each other.

Further, the gas ejection nozzle 28*a* is a gap, that is, a slit formed between the inner top panel part 17*a* and the lower top panel part 17*b*. The width of the slit is adjustable and the slit is formed circumferentially and concentric with the top panel. Here, the gas ejection nozzle 28*a* may be of any form as far as it can eject the mixed gas (here, a mixed gas of argon and methane) toward the tail of the thermal plasma flame 24, so the gas ejection nozzle 28*a* is not limited to the slit form as described above and may be in the form of, for example, a plurality of holes arranged circumferentially.

The interior of the upper outer top panel part 17*c* is provided with an aeration passage 17*d* for passing the mixed gas A (composed of argon and methane) to be sent through the pipe 28*e*, and an aeration passage 17*e* for passing a gas B (i.e., argon). The mixed gas A (composed of argon and methane) to be sent through the pipe 28*e* passes through the aeration passage 17*d* and through the gas ejection nozzle 28*a* which is a slit formed between the inner top panel part 17*a* and the lower top panel part 17*b* as described above, and is sent into the chamber 16. The gas B (i.e., argon) to be sent through the pipe 28*c* passes through the aeration passage 17*e* and through the gas ejection nozzle 28*b* which is also a slit, and is sent into the chamber 16.

The above-mentioned mixed gas A (composed of argon and methane) sent to the gas ejection nozzle 28*a* is ejected from the directions shown by arrows S in FIG. 4 through the aeration passage 17*d* toward the directions indicated by arrows Q in FIGS. 1 and 4, that is, toward the tail (i.e., end portion) of the thermal plasma flame in the predetermined supply amount and at the predetermined angle as described above. The gas B (here, argon) sent to the gas ejection nozzle 28*b* is ejected from the directions indicated by arrows T shown in FIG. 4 through the aeration passage 17*e* toward the directions indicated by arrows R in FIGS. 1 and 4 so that the generated ultrafine particles 18 can be supplied such that they are prevented from being adhered onto the inner wall of the chamber 16.

Here, the predetermined supply amount of the mixed gas A (composed of argon and methane) is explained. As described above, the supply amount sufficient for quenching the vapor-phase mixture is preferably an amount in which, in the chamber 16 formed for providing a space necessary for quenching the vapor-phase mixture, the mixed gas A to be introduced thereinto has an average flow rate in the chamber 16 (i.e., flow rate in the chamber) of 0.001 to 60 m/sec, or more preferably 0.01 to 10 m/sec. Such a range of the average flow rate of the mixed gas of 0.001 to 60 m/sec is a gas supply amount sufficient for quenching the vapor-phase mixture obtained by evaporating the powder material 144 (cf. FIG. 3) or the like sprayed into the thermal plasma flame 24 to generate ultrafine particles, and for preventing agglomeration of the resultant ultrafine particles due to collisions thereof.

Note that this supply amount is required to be an amount sufficient for quenching the vapor-phase mixture to condense/solidify it, and also an amount sufficient for diluting the vapor-phase mixture so that they do not cohere and coagulate or condense/solidify as a result of collision of ultrafine particles immediately after their generation. A value of the supply amount may be determined appropriately depending on the shape and size of the chamber 16.

However, it is preferable that the supply amount be controlled so as not to inhibit the stabilization of the thermal plasma flame.

The supply amount of the reactive gas (here, methane) in the mixed gas A is not particularly limited as far as a thin film including an elementary carbon substance and/or a carbon compound can be formed on the surfaces of the ultrafine particles generated from a predetermined amount of the powder material (144) sprayed into the thermal plasma flame 24. It is preferable in any case that the reactive gas be contained in the mixed gas A in an amount on the order of 0.1 to 10% of argon.

Figure 5A:
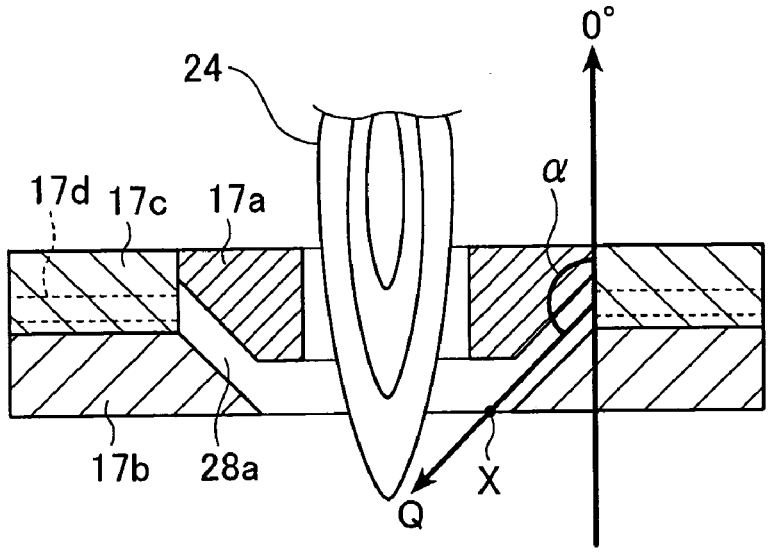
FIGS. 5A and 5B are diagrams each illustrating an angle of a gas ejected from the gas ejection nozzle shown in FIG. 4, with FIG. 5A showing a cross section in a vertical direction through the central axis of the top panel of the chamber, and FIG. 5B being a bottom view of the top panel.
Figure 5B:
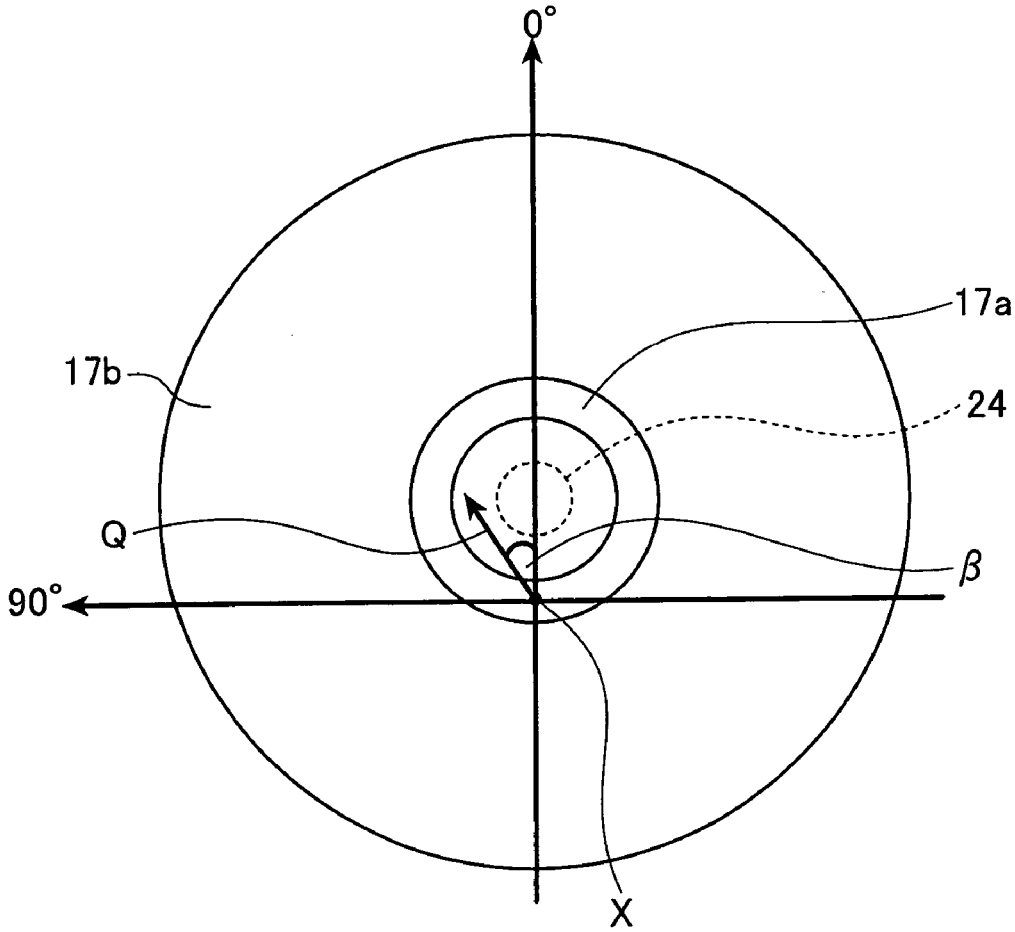

Next, referring to FIG. 5, the predetermined angle in the case where the gas ejection nozzle 28*a* is in the form of a slit is explained. FIG. 5A is a cross-sectional view in a vertical direction through a central axis of the top panel 17 of the chamber 16. Also, FIG. 5B is a bottom view of the top panel 17. Note that in FIG. 5B, a view taken along a direction perpendicular to the direction in which the cross-section shown in FIG. 5A is viewed is indicated. Here, the point X in each of FIGS. 5A and 5B is an ejection point at which the mixed gas A of gases sent from the first gas source 28*d* and the second gas source 28*f* (cf. FIG. 1) through the aeration passage 17*d* is ejected into the inside of the chamber 16 from the gas ejection nozzle 28*a*. The gas ejection nozzle 28*a* is actually a circular slit, so the mixed gas A upon ejection forms a gas stream in the form of a band. Therefore, the point X is an imaginary point of ejection.

As shown in FIG. 5A, when the center of the opening of the aeration passage 17*d* is a point of origin, the upright direction is 0°, the counterclockwise direction on paper is defined as a positive direction, and an angle at which a gas is ejected from the gas ejection nozzle 28*a* in the direction indicated by an arrow Q is defined as an angle $\alpha$. The angle $\alpha$ is an angle between the direction in which a gas is ejected and the direction from the head (i.e., start portion) to the tail (i.e., end portion) of the thermal plasma flame (usually vertical direction).

Further, as shown in FIG. 5B, when the above-mentioned imaginary ejection point X is a point of origin, the direction from the ejection point X toward the center of the thermal plasma flame 24 is 0°, the counterclockwise direction on paper is defined as a positive direction, and an angle of the direction in which the gas is ejected from the gas ejection nozzle 28*a* as indicated by an arrow Q in a direction of a plane perpendicular to the direction from the head (i.e., start portion) to the tail (i.e., end portion) of the thermal plasma flame 24 is defined as an angle $\beta$. The angle $\beta$ is an angle relative to the central portion of the thermal plasma flame in a plane perpendicular to the direction from the head (i.e., start portion) to the tail (i.e., end portion) of the thermal plasma flame (usually in a horizontal plane).

Using the above-mentioned angle $\alpha$ (usually an angle in the vertical direction) and the angle $\beta$ (usually an angle in the horizontal direction), the predetermined angle, that is, the direction of introduction of the gas into the chamber is set such that in the chamber 16, the angle $\alpha$ is preferably in the range of $90° < \alpha < 240°$, more preferably in the range of $100° < \alpha < 180°$, and most preferably $\alpha = 135°$ with respect to the tail (i.e., end portion) of the thermal plasma flame 24, and the angle $\beta$ is preferably in the range of $-90° < \beta < 90°$, more preferably in the range of $-45° < \beta < 45°$, and most preferably $\beta = 0°$.

As described above, by the mixed gas A ejected in the predetermined amount and at the predetermined angle toward the thermal plasma flame 24, the vapor-phase mixture is quenched to generate ultrafine particles 18. The mixed gas A ejected into the chamber 16 at the predetermined angle as described above does not always reach the tail of the thermal plasma flame 24 at the angle at which the mixed gas is ejected due to the influence of turbulent flow or the like generated in the chamber 16. However, it is preferable to determine the angle of the mixed gas A at the above-mentioned angle in order to effectively cool the vapor-phase mixture, stabilize the thermal plasma flame 24, and efficiently operate the ultrafine particle producing apparatus 10. Note that the above-mentioned angle can be determined experimentally while taking into consideration conditions such as the size of the apparatus and size of the thermal plasma flame.

On the other hand, the gas ejection nozzle 28*b* is a slit formed in the lower top panel part 17*b*. The gas ejection nozzle 28*b* is to introduce the gas B into the chamber 16 in order to prevent the generated ultrafine particles 18 from adhering to the inner wall of the chamber 16.

The gas ejection nozzle 28*b* is a slit circumferentially formed and concentric with the top panel 17. However, the gas ejection nozzle does not have to be a slit as far as it has a shape that can sufficiently achieve the above-mentioned purpose.

Here, the gas B introduced into the top panel 17 (more specifically, lower top panel part 17*b* ) from the first gas source 28*d* via the pipe 28*c* passes through the aeration passage 17*e* and is ejected from the gas ejection nozzle 28*b* along the inner wall of the chamber 16 from above to below in directions indicated by arrows R shown in FIGS. 1 and 4.

This operation gives rise to the effect of preventing the ultrafine particles from adhering to the inner wall of the chamber 16 in the process of collecting the ultrafine particles. The amount of the gas B to be ejected from the gas ejection nozzle 28*b* is not particularly limited as far as the amount is sufficient for achieving the purpose; it does not have to be an unnecessarily large amount and may be an amount sufficient for preventing the ultrafine particles from adhering to the inner wall of the chamber 16. That is, the supply amount of the gas B may be set as appropriate depending on the size and state of the thermal plasma flame 24, the size of the chamber 16, and the size and state of the inner wall surface of the chamber 16. For example, the supply amount of the gas B is preferably about 1.5 to 5 times as large as that of the mixed gas A.

Note that a pressure gauge 16*p* provided on the side wall of the chamber 16 shown in FIG. 1 is to monitor the pressure in the chamber 16 and is mainly used to detect a change in the amount of gas supplied into the chamber 16 as described above, and is also used to control the pressure in the system.

As shown in FIG. 1, on a side of the chamber 16, a collecting section 20 for collecting the generated ultrafine particles 18 is provided. The collecting section 20 includes a collecting chamber 20*a*, a filter 20*b* provided in the collecting chamber 20*a*, and a vacuum pump (not shown) connected through a pipe 20*c* provided in an upper part of the collecting chamber 20*a*. The generated ultrafine particles are sucked into the collecting chamber 20*a* by being sucked by the vacuum pump, and remain on the surface of the filter 20*b* and are then collected.

Then, while stating the operation of the ultrafine particle producing apparatus 10, the process for producing ultrafine particles according to one embodiment of the present invention using the ultrafine particle producing apparatus 10, and the ultrafine particles generated by the production process will be explained.

In the process for producing ultrafine particles according to this embodiment, first, a powder material which is a material for producing ultrafine particles is charged in the material supplying apparatus 14.

Here, preferably, the particle size of the powder material to be used is, for example, 10 μm or less.

Here, the powder material is not particularly limited as far as it can be evaporated by the thermal plasma flame. Preferable examples thereof include the following. That is, metals, alloys, simple oxides, composite oxides, double oxides, oxide solid solutions, hydroxides, carbonate compounds, halides, sulfides, nitrides, carbides, hydrides, metal salts, and organometal compounds that contain at least one element selected from the group consisting of elements having atomic numbers of 12, 13, 26 to 30, 46 to 50, 62, and 78 to 83, which may be selected as appropriate.

Note that the simple oxides refer to oxides consisting of oxygen and one element in addition to the oxygen. The composite oxides refer to oxides of plural species. The double oxides refer to higher oxides consisting of two or more kinds of oxides. The oxide solid solutions refer to solids obtained by uniformly dissolving different oxides with each other. Further, the metals refer to substances constituted of one or more metal elements only. The alloys refer to substances constituted of two or more metal elements. Organized conditions of the metals or alloys may include solid solutions, eutectic mixtures, intermetallic compounds, and mixtures thereof.

The hydroxides refer to substances constituted of a hydroxyl group and one or more metal elements. The carbonate compounds refer to compounds constituted of a carbonate group and one or more metal elements. The halides refer to compound constituted of a halogen atom and one or more metal elements. The sulfides refer to compounds constituted of sulfur and one or more metal elements. The nitrides refer to compounds constituted of nitrogen and one or more metal elements. The carbides refer to compounds constituted of carbon and one or more metal elements. The hydrides refer to compounds constituted of hydrogen and one or more metal elements. The metal salts refer to ionic compounds that contain at least one metal element. The organometal compounds refer to organic compounds that contain a bond of one or more metal elements with at least any of elements C, O, and N, and examples thereof include metal alkoxides and organometal complexes.

Next, the materials for producing ultrafine particles are subjected to gas-entrainment using a carrier gas and introduced through the introduction pipe 14*a* for introducing the material into the plasma torch 12 into the thermal plasma flame 24 where the materials are evaporated to form a vapor-phase mixture. That is, the powder materials introduced in the thermal plasma flame 24 are supplied into the plasma torch 12, thereby being introduced into the thermal plasma flame 24 generating in the plasma torch 12 and evaporated, and as a result, a vapor-phase mixture is formed.

Note that the powder materials have to become a vapor-phase in the thermal plasma flame 24, so the temperature of the thermal plasma flame 24 must be higher than the boiling point of the powder materials. On the other hand, the higher the temperature of the thermal plasma flame 24, the easier the materials become a vapor-phase, which is preferable. The temperature is not particularly limited and may be selected as appropriate depending on the materials. For example, the temperature of the thermal plasma flame 24 may be set to 6,000° C., and theoretically, the temperature can reach about 10,000° C.

Further, the pressure atmosphere in the plasma torch 12 is preferably atmospheric pressure or less. Here, the atmosphere at atmospheric pressure or less is not particularly limited and may be set to, for example, 0.5 to 100 kPa.

Then, the vapor-phase mixture obtained by evaporating the powder material in the thermal plasma flame 24 is quenched in the chamber 16 to generate ultrafine particles 18. In particular, the vapor-phase mixture in the thermal plasma flame 24 is quenched with the mixed gas A ejected as a first introduction gas in the directions indicated by arrows Q toward the tail (i.e., end portion) of the thermal plasma flame at a predetermined angle and in a predetermined amount through the gas ejection nozzle 28*a* to generate the ultrafine particles 18.

If the ultrafine particles immediately after generation collide with each other to form agglomerates, thereby generating nonuniformity in particle size, this causes a reduction in quality. On the contrary, in the process for producing ultrafine particles according to the present invention, the mixed gas A that is ejected in the directions indicated by the arrows Q through the gas ejection nozzle 28*a* toward the tail (i.e., end portion) of the thermal plasma flame at a predetermined angle and in a predetermined supply amount dilutes the ultrafine particles 18 to prevent collision and agglomeration between the ultrafine particles.

Further, the reactive gas in the mixed gas A is decomposed and/or reacts under the temperature and pressure conditions in the chamber 16, and generates an elementary carbon substance and/or a carbon compound on the surfaces of the generated ultrafine particles 18, or the generated elementary carbon substance and/or carbon compound are adsorbed on the surfaces of the ultrafine particles 18 to prevent agglomeration and coalescence of the ultrafine particles and oxidation thereof.

That is, the mixed gas A ejected from the gas ejection nozzle 28*a* quenches the vapor-phase mixture to further prevent agglomeration of the generated ultrafine particles, and at the same time, the elementary carbon substance and/or carbon compound derived from the reactive gas in the ejected mixed gas A covers the surfaces of the ultrafine particles to make the particles smaller and uniform in size, and to prevent agglomeration and coalescence of the particles as well as oxidation thereof, which is a great characteristic of the present invention.

Incidentally, the mixed gas A ejected from the gas ejection nozzle 28*a* gives adverse influence on the stability of the thermal plasma flame 24 more or less. However, to run the whole apparatus continuously, it is necessary to stabilize the thermal plasma flame. For this purpose, the gas ejection nozzle 28*a* in the ultrafine particle producing apparatus 10 according to this embodiment is formed as a circumferential slit, and controlling the width of the slit enables adjustment of the supply amount and ejection speed of the mixed gas A. This makes it possible to eject the mixed gas A uniformly in the direction toward the center of the flame. Therefore, it can be said that the gas ejection nozzle 28*a* has a shape desirable for stabilizing the thermal plasma flame. Further, this adjustment can be performed by changing the supply amount of the mixed gas A to be ejected.

On the other hand, the gas B, which is the second introduction gas, is ejected in the directions indicated by the arrows R shown in FIGS. 1 and 4 through the gas ejection nozzle 28*b* along the inner wall of the chamber 16 from above to below. This prevents the ultrafine particles 18 from adhering to the inner wall of the chamber 16 in the process of collecting the ultrafine particles, thereby increasing the yield of the generated ultrafine particles. Finally, the ultrafine particles generated in the chamber 16 are sucked by a vacuum pump (not shown) connected to the pipe 20*c* and collected on the filter 20*b* of the collecting section 20.

Here, in general, as the carrier gas or spray gas, there can be used air, nitrogen, oxygen, argon, hydrogen, or the like as described above. In the case where the generated ultrafine particles are ultrafine metal particles, argon can be advantageously used as the carrier gas or spray gas.

The reactive gas in the first introduction gas may be any of various gases as far as it can be decomposed or react in the thermal plasma to generate elementary carbon. For example, in addition to the above-mentioned methane, various hydrocarbon gases such as ethane, propane, butane, acetylene, ethylene, propylene, and butene (hydrocarbon compounds having four or less carbon atoms) can suitably be used. Further, the elementary carbon is preferably one that tends to be generated or adsorbed with ease on the surfaces of the above-mentioned ultrafine particles generated.

The ultrafine particles produced by the production process according to this embodiment have a narrow particle size distribution, that is, the ultrafine particles have uniform particle size and less contamination of bulky particles. To be specific, the ultrafine particles of the present invention have an average particle size of 1 to 100 nm. In the process for producing ultrafine particles according to this embodiment, a thin film can be formed on the surface of the ultrafine particles made of, for example, any one of simple inorganic substances, simple oxides, composite oxides, double oxides, oxide solid solutions, metals, alloys, hydroxides, carbonate compounds, phosphate compounds, halides, sulfides, simple nitrides, composite nitrides, simple carbides, composite carbides, and hydrides.

In the action of the reactive gas in this embodiment, the reactive gas is decomposed or reacts under the temperature and pressure conditions in the chamber 16 and generates an elementary carbon substance and/or a carbon compound on the surfaces of the generated ultrafine particles 18, or the generated elementary carbon substance and/or carbon compound are adsorbed on the surfaces of the ultrafine particles 18 to generate ultrafine particles coated with the elementary carbon substance and/or the carbon compound on the surfaces thereof.

That is, as described above, the ultrafine particles generated by the process for producing ultrafine particles according to this embodiment have a small particle size as described above and the surface activity thereof becomes extremely high, so the coating of the surfaces of the ultrafine particles with the elementary carbon substance and/or the carbon compound as described above is performed rapidly in a short period of time.

Note that the mixed gas A to be ejected as described above can prevent ultrafine particles generated by quenching and condensing/solidifying of the vapor-phase mixture from collision and agglomeration thereof. That is, the process for producing ultrafine particles according to the present invention involves the steps of quenching the vapor-phase mixture and coating the surfaces of the generated ultrafine particles with an elementary carbon substance and/or a carbon compound to prevent agglomeration and coalescence as well as oxidation of the ultrafine particles and, at the same time, produce with high productivity ultrafine particles of a very small and uniform particle size having high quality and high purity. Consequently, the elementary carbon substance and/or the carbon compound derived from the decomposition and/or reaction of the reactive gas can be deposited uniformly to the surfaces of the ultrafine particles generated in the above-mentioned steps.

Further, the process for producing ultrafine particles according to this embodiment can exhibit cooling effects, in which a gas stream, which contains a plasma gas, a carrier gas, a gas derived from supply materials (i.e., vapor-phase mixture), and a reactive gas, is generated in the chamber 16 by evacuation operation or the like of the vacuum pump provided in the collecting section, thereby leading the vapor-phase mixture to a place sufficiently distant from the thermal plasma flame to realize cooling. It also exhibits the effect of quenching the vapor-phase mixture with the mixed gas (i.e., cooling gas and reactive gas) that is ejected toward the tail (i.e., end portion) of the thermal plasma flame.

Hereinafter, examples in which the apparatus according to the above-mentioned embodiment is used will be explained.

EXAMPLE 1

First, an example in which ultrafine particles of silver were produced and agglomeration and coalescence of the particles to each other were prevented is presented.

As a material, a silver powder having an average particle size of 4.5 μm was used.

Further, argon was used as a carrier gas.

The high frequency oscillation coil 12*b* in the plasma torch 12 was applied with high frequency voltage of about 4 MHz and about 80 kVA, and a mixed gas of 80 liters/min of argon and 5 liters/min of hydrogen was introduced as the plasma gas from the plasma gas source 22 to generate an argon/hydrogen thermal plasma flame in the plasma torch 12. Note that, here, the reaction temperature was controlled to be about 8,000° C. and 10 liters/min of a carrier gas was supplied from the carrier gas source 15 of the material supplying apparatus 14.

The silver powder together with argon as a carrier gas was introduced into the thermal plasma flame 24 in the plasma torch 12.

Among the mixed gases to be introduced into the chamber 16 by the gas introduction apparatus 28, the mixed gas A to be ejected from the gas ejection nozzle 28*a* was a mixture of 150 liters/min of argon and 2.5 liters/min of methane as the reactive gas, and the gas B ejected from the gas ejection nozzle 28*b* was 50 liters/min of argon. The flow rate in the chamber was 0.25 m/sec. The pressure in the chamber 16 was 50 kPa.

Figure 6:
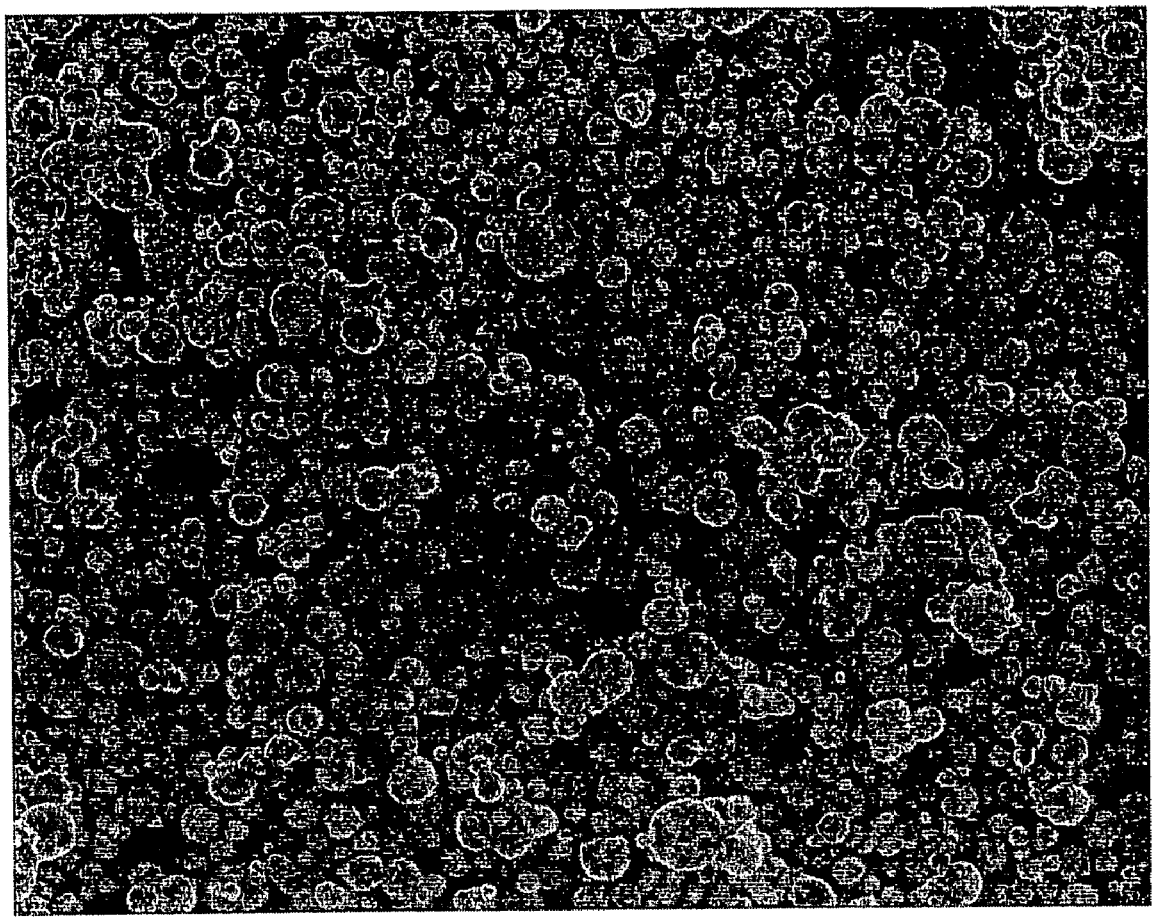
FIG. 6 is an electron micrograph of the particles according to Example 1 (at a magnification of 50,000 times)
Figure 7:
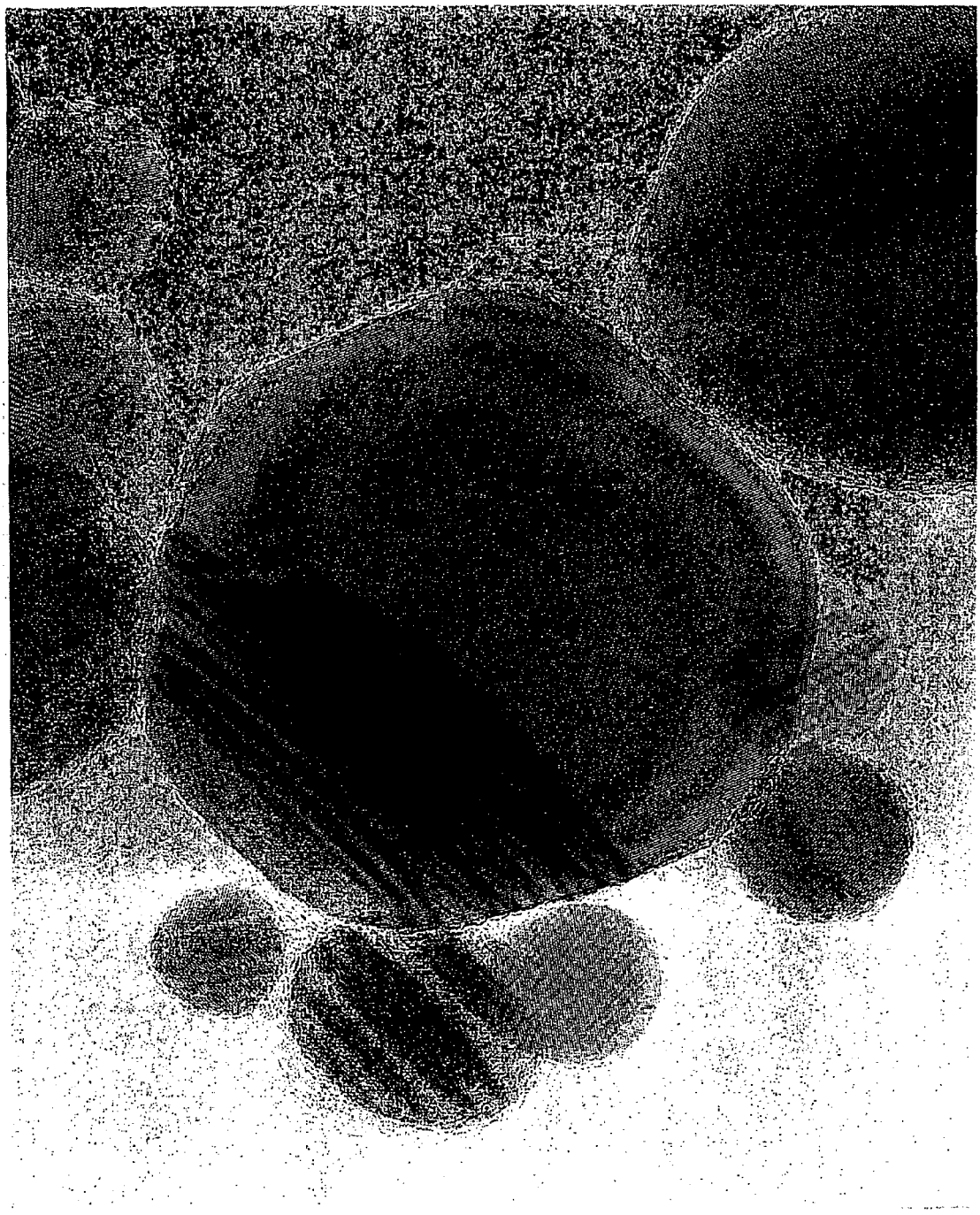
FIG. 7 is an electron micrograph of the particles of Example 1 (at a magnification of 2,000,000 times)
Figure 8:
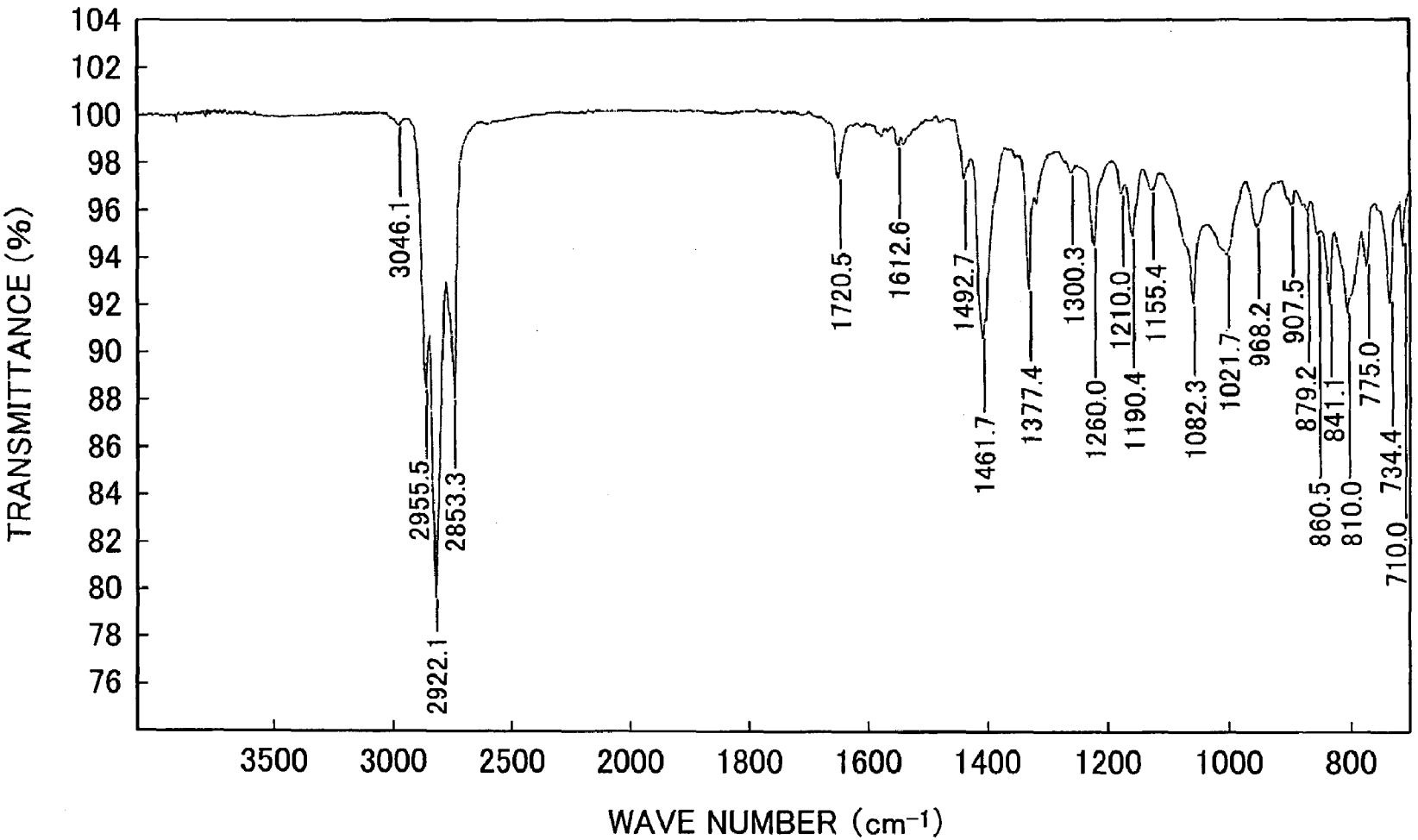
FIG. 8 is a graph showing an infrared absorption spectrum of the film coated on the surfaces of the particles of Example 1.

The particle size calculated from the specific surface area (i.e., surface area per g) of the fine silver particles produced under the above-mentioned production conditions was 70 nm. FIGS. 6 and 7 are electron micrographs of fine silver particles generated under the above-mentioned production conditions. FIG. 6 is a photograph taken with a scanning electron microscope and observation of the surface of the fine silver particles revealed that substantially no coalescence between the particles occurred. Further, FIG. 7 is a photograph taken with a transmission electron microscope and a film formed on the surface of the ultrafine particles was observed. FIG. 8 is a diagram showing results of measurement of infrared absorption spectrum of the surface coating substance extracted from the silver nanoparticles coated with the elementary carbon substance and/or the carbon compound with chloroform.

As shown in FIG. 8, absorption ascribable to atomic groups of paraffins including —$CH_2$— and olefins appeared at 1,350 to 1,450 $cm^{-1}$ and at 2,800 to 3,100 $cm^{-1}$, respectively. Absorption ascribable to an aromatic atomic group including a benzene ring appeared at 700 to 900 $cm^{-1}$ and at 1,450 to 1,650 $cm^{-1}$. Absorption ascribable to the atomic group of carboxylate (–COOH) appeared at 1,200 to 1,300 $cm^{-1}$ and at 1,650 to 1,750 $cm^{-1}$. The results confirmed that the surface coating film of the ultrafine particles is constituted of a carbon compound (i.e., hydrocarbon compound).

Note that the ultrafine particles generated by the present example had an yield of 40% since the amount of the ultrafine silver particles collected per 100 g of the charged powder material was 40 g.

EXAMPLE 2

Next, an example is shown in which the ultrafine silver particles were produced in the same manner as in Example 1, and the amount of the reactive gas was changed to control the particle size.

As the material, a silver powder having an average particle size of 4.5 μm was used.

Further, argon was used as the carrier gas.

Here, the high frequency voltage to be applied to the plasma torch 12 and the supply amount of the plasma gas were the same as those used in Example 1, and an argon/hydrogen thermal plasma flame was generated in the plasma torch 12. Note that the reaction temperature was controlled to be about 8,000° C., and the supply amount of the carrier gas from the carrier gas source 15 of the material supplying apparatus 14 was set to 10 liters/min.

The silver powder was introduced into the thermal plasma flame 24 in the plasma torch 12 together with argon as the carrier gas.

Among the gases to be introduced into the chamber 16 by the gas introduction apparatus 28, the gas to be ejected from the gas ejection nozzle 28*a* was a mixture of 150 liters/min of argon and 5.0 liters/min of methane as the reactive gas, and the gas to be ejected from the gas ejection nozzle 28*b* was 50 liters/min of argon. The flow rate in the chamber was 0.25 m/sec. The pressure in the chamber 16 was 50 kPa.

Figure 9:
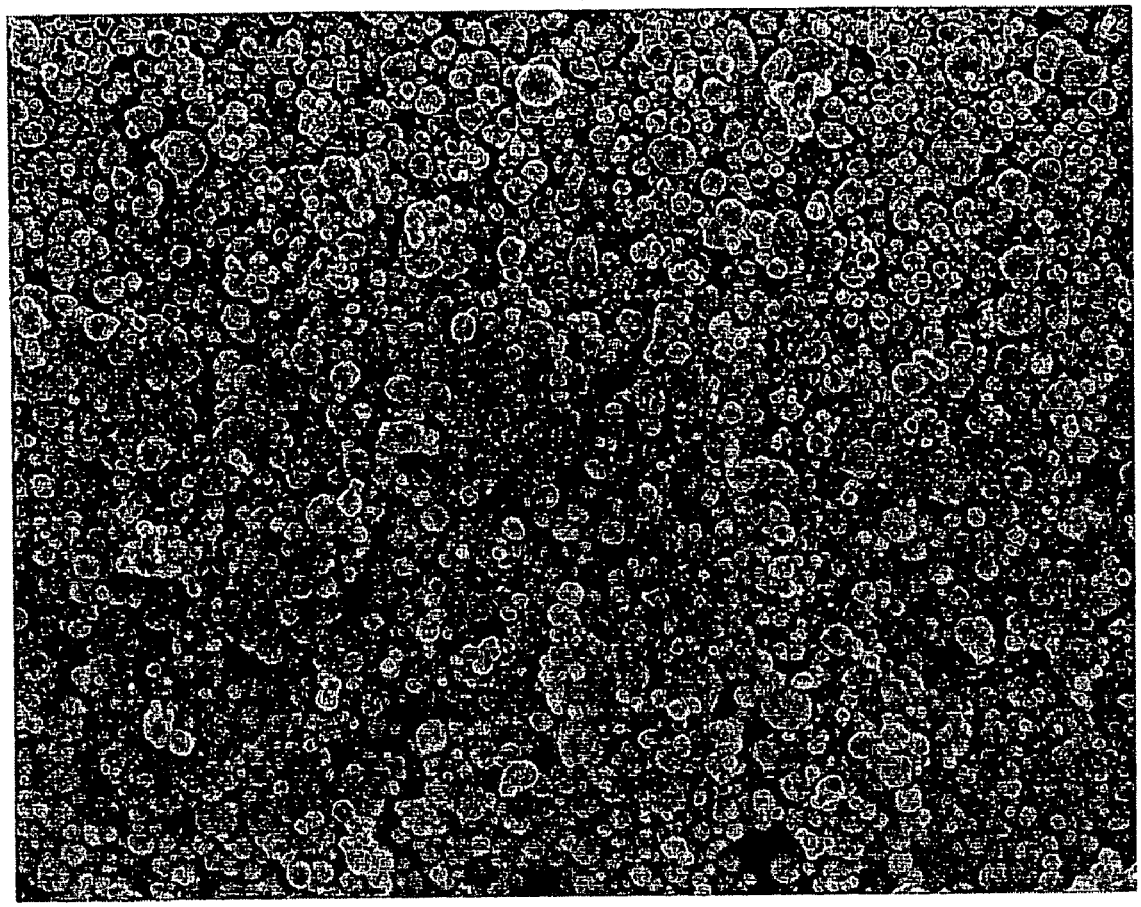
FIG. 9 is an electron micrograph of the particles of Example 2 (at a magnification of 50,000 times)

The particle diameter calculated from the specific surface area of the ultrafine silver particles generated under the above-mentioned production conditions was 40 nm. FIG. 9 shows a scanning electron micrograph of the particles. Further, observation of the surface of the ultrafine silver particles with a transmission electron microscope confirmed lamellar coatings of the elementary carbon substance and/or the carbon compound and revealed that substantially no coalescence between the particles occurred. Further, the yield of the generated ultrafine particles was 45% since the amount of the ultrafine silver particles collected per 100 g of the charged powder material was 45 g.

EXAMPLE 3

Next, an example will be shown in which ultrafine copper particles were produced and agglomeration and coalescence between the particles were prevented.

As the material, a copper powder having an average particle size of 5.0 μm was used.

Further, argon was used as the carrier gas.

Here, the high frequency voltage to be applied to the plasma torch 12 and the supply amount of the plasma gas were the same as those used in Examples 1 and 2, and an argon/hydrogen thermal plasma flame was generated in the plasma torch 12. Note that the reaction temperature was controlled to be about 8,000° C., and the supply amount of the carrier gas from the carrier gas source 15 of the material supplying apparatus 14 was set to 10 liters/min.

The copper powder was introduced into the thermal plasma flame 24 in the plasma torch 12 together with argon as the carrier gas.

Among the gases to be introduced into the chamber 16 by the gas introduction apparatus 28, the mixed gas A to be ejected from the gas ejection nozzle 28*a* was a mixture of 150 liters/min of argon and 5.0 liters/min of methane as the reactive gas, and the gas B to be ejected from the gas ejection nozzle 28*b* was 50 liters/min of argon. The flow rate in the chamber was 0.25 m/sec. The pressure in the chamber 16 was 35 kPa.

The particle diameter calculated from the specific surface area of the ultrafine copper particles generated under the above-mentioned production conditions was 20 nm. Observation of the surface of the ultrafine copper particles with a transmission electron microscope confirmed lamellar coatings of the elementary carbon substance and/or the carbon compound and revealed that substantially no coalescence between the particles occurred. Further, it was confirmed by X-ray diffraction analysis that the ultrafine particles immediately after the production were composed of copper.

Figure 10:
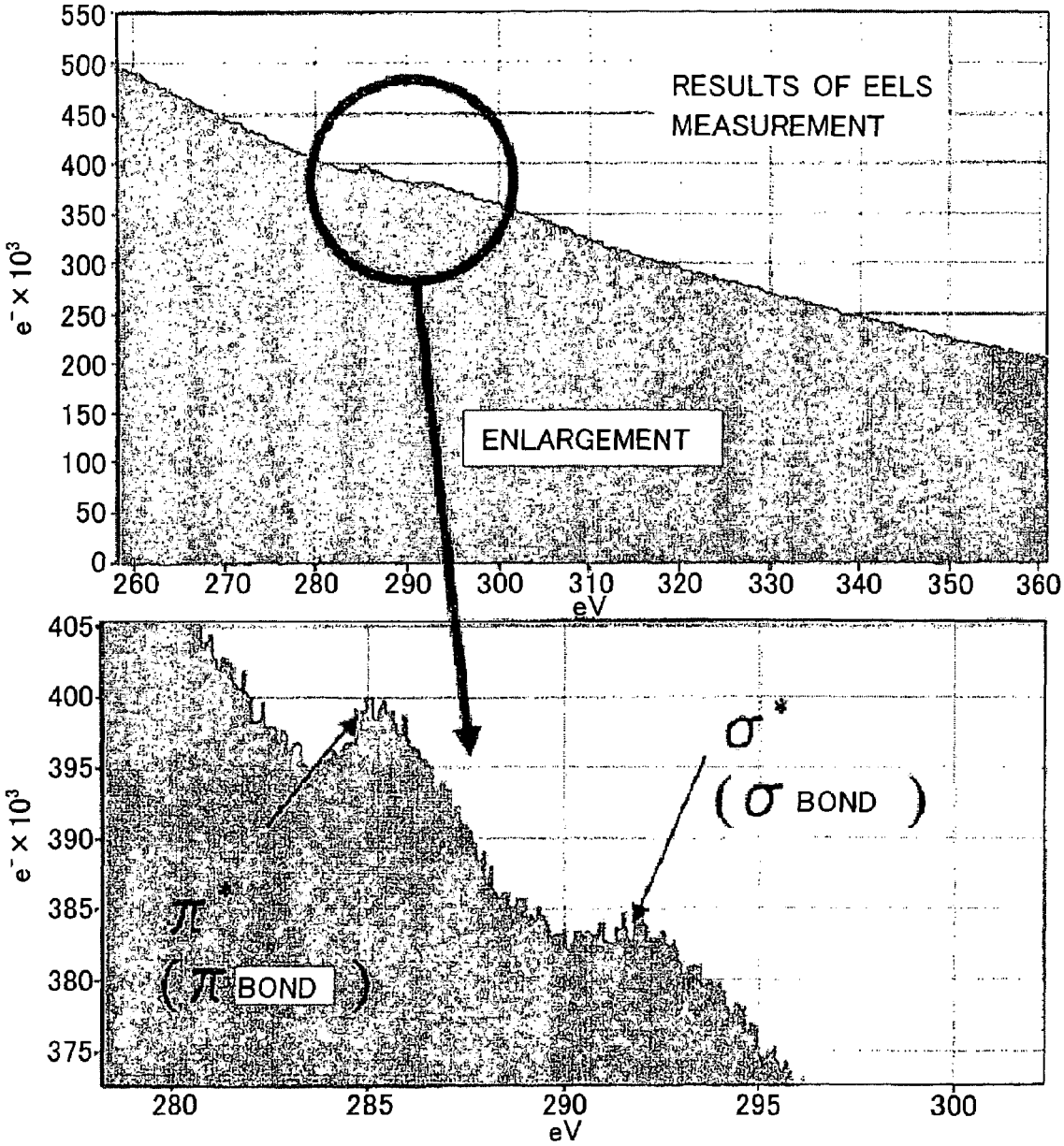
FIG. 10 is a diagram containing two graphs showing the results of measurement of the film coated on the surfaces of the particles of Example 3 by an electron energy loss spectroscopy.

FIG. 10 shows results of measurement of the coating film on the surface of the silver nanoparticles prepared by the process of the present invention by an electron energy loss spectroscopy in combination with transmission electron microscopy.

According to this measurement, not only σ bonds but also π bonds can be confirmed simultaneously, so it can be confirmed that the surface coating film of the ultrafine particles contains not only the carbon compound (cf. FIG. 8) confirmed by the measurement of infrared absorption spectrum but also elementary carbon such as graphite.

Further, the ultrafine copper particles after being left to stand in air for 3 weeks showed substantially no oxidation.

Note that the yield of the generated ultrafine particles was 40% since the amount of the ultrafine copper particles collected per 100 g of the charged powder material was 40 g.

The results in Examples 1 to 3 indicate that, by controlling the flow rates of the mixed gas A and the gas B, respectively, in the production of ultrafine particles, the size of the generated ultrafine particles and the thickness of the coating thin film formed on the surface thereof can be set to desired values.

However, the controlling conditions can not be collectively determined because the controlling conditions depend on other conditions, so currently it is necessary to determine them by trial and errors.

COMPARATIVE EXAMPLE

Next, as a comparative example, an example of producing ultrafine silver particles is shown, in which the apparatus according to an embodiment of the present invention was used and the reactive gas was mixed with the carrier gas instead of being ejected from the gas ejection nozzles 28*a*.

As the material, a silver powder having an average particle size of 4.5 μm was used.

Further, a mixture of 9.0 liters/min of argon and 1.0 liters/min of methane as a reactive gas was used as the carrier gas.

Here, too, the high frequency voltage to be applied to the plasma torch 12 and the supply amount of the plasma gas were the same as those used in Examples 1 to 3, and an argon/hydrogen thermal plasma flame was generated in the plasma torch 12. Note that the reaction temperature was controlled to be about 8,000° C., and the supply amount of the carrier gas from the carrier gas source 15 of the material supplying apparatus 14 was set to 10 liters/min.

The silver powder was introduced into the thermal plasma flame 24 in the plasma torch 12 by means of the mixture of argon and methane as the carrier gas.

Among the gases to be introduced into the chamber 16 by the gas introduction apparatus 28, the gas to be ejected from the gas ejection nozzle 28*a* was 150 liters/min of argon, and the gas to be ejected from the gas ejection nozzle 28*b* was 50 liters/min of argon. The flow rate in the chamber was 0.25 m/sec. The pressure in the chamber 16 was 50 kPa.

Figure 11:
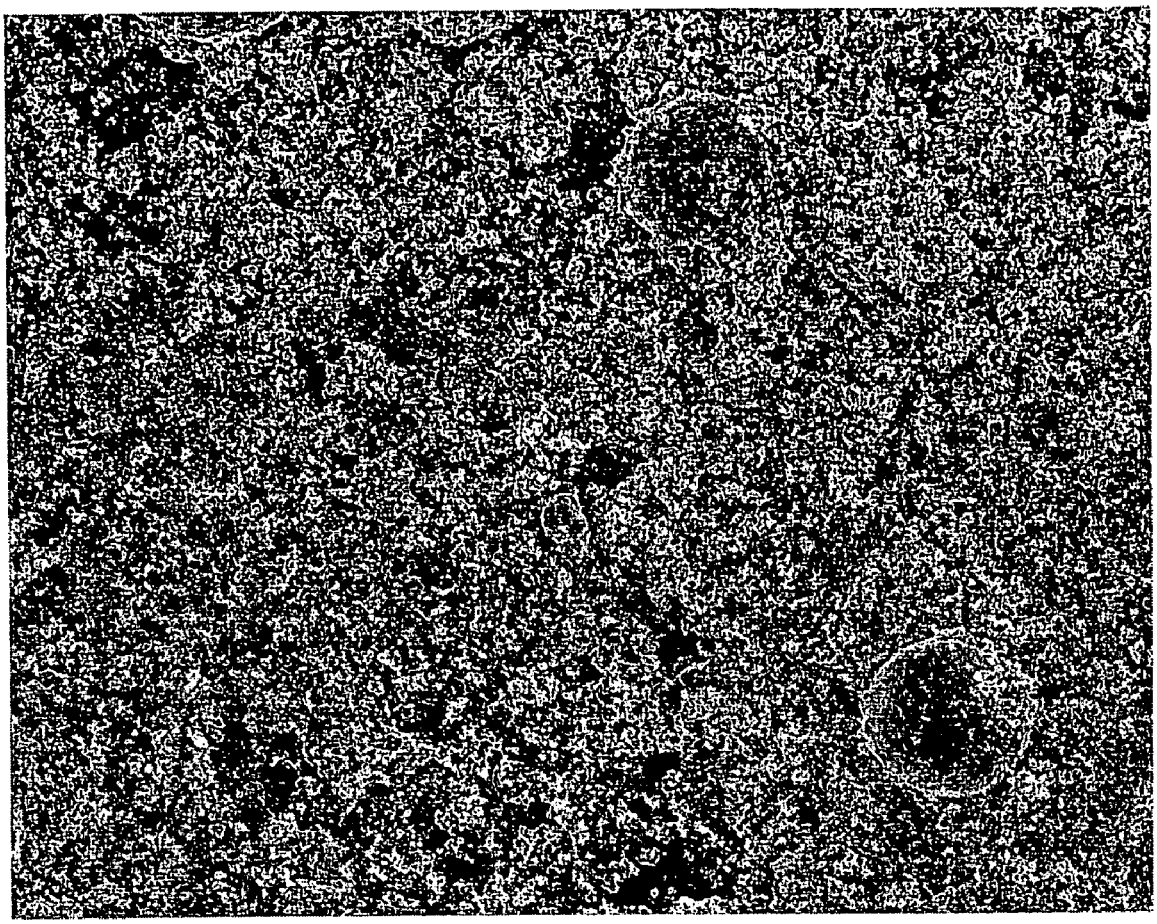
FIG. 11 is an electron micrograph of the particles of Comparative Example (at a magnification of 5,000 times).

Observation of the ultrafine silver particles generated under the above-mentioned production conditions with a scanning electron microscope confirmed that not only ultrafine particles but also large particles derived from the material that remained undissolved or graphite derived from methane as the reactive gas were present, so it was impossible to realize uniformity in particle size or shape. FIG. 11 shows an electron micrograph of particles.

Table 1 summarizes results of subsequent experiments on changes in particle size of the resultant ultrafine particles with varied flow rates of the mixed gas (i.e., argon and methane) as a gas to be introduced into the chamber 16 upon production of ultrafine silver particles similar to the ultrafine silver particles as shown in Examples 1 and 2. Here, the flow rate of argon was changed to 100 liters/min and 150 liters/min, and the flow rate of methane was changed to 0.5 liters/min to 5.0 liters/min.

Note that in Table 1, BET refers to specific surface area and $D_{BET}$ indicates the particle size of ultrafine particles calculated therefrom.

TABLE 1

| Ar [L/min] | 100 | | | 165 | |
|---|---|---|---|---|---|
| $CH_4$ [L/min] | 0.5 | 1.0 | 5.0 | 2.5 | 5.0 |
| BET [$m^2$/g] | 5.3 | 5.0 | 8.1 | 8.0 | 14.0 |
| $D_{BET}$ [nm] | 109 | 115 | 71 | 72 | 41 |

Note that the above-mentioned embodiments and examples show examples of the present invention. The present invention is not limited thereto and various modifications and improvements may be made without departing from the gist of the present invention.

For example, to stabilize the thermal plasma flame, when the raw material for producing ultrafine particles is introduced into the thermal plasma flame, it is effective that a combustible material that burns by itself be added and mixed. In this case, the ratio by weight of the powder material to the combustible material may be, for example, 95:5, but it is not limited thereto.

Further, also regarding the method of supplying the cooling gas and reactive gas into the chamber 16, various modifications and combinations can be made. For example, there can be adopted a method in which the gas ejection nozzles 28*a* and 28*b* in FIG. 4 are used as dedicated nozzles for a cooling gas, and in which a dedicated nozzle for the reactive gas is newly provided near an outside of the gas ejection nozzle 28*a*, a method in which the reactive gas is introduced into the midway of the gas ejection nozzle 28*a* in the top panel 17, and so on. In this case, respective gases are guided without being mixed with each other until they reach the chamber 16, so an advantage can be obtained in that the mixing operation in the midway of the piping becomes unnecessary.

Further, as a variation of the process for producing ultrafine particles each coated with a thin film according to the present invention, a method may be employed in which a mixture of the reactive gas with the carrier gas is used as in the comparative example. In this case, although there is the possibility that bulky particles of the powder material might remain, such a method can be also put into practice if a classifying operation or the like can be added as a post treatment step.

What is claimed is:

1. A process for producing ultrafine particles each coated with a thin film, said method comprising the steps of:

introducing materials for producing the ultrafine particles into a thermal plasma flame having a center axis, the materials being introduced along the center axis of the thermal plasma flame in a chamber under reduced pressure to form a vapor-phase mixture;

introducing a mixed gas of a reactive gas and a cooling gas toward an end portion of the thermal plasma flame through an annular slit-like nozzle on said chamber and surrounding the outer periphery of the thermal plasma flame and having a substantially conical shape with an axis that is substantially identical with the center axis of the thermal plasma flame and whose diameter is gradually reduced in a direction to the end portion of the thermal plasma flame in supply amounts sufficient for quenching the vapor-phase mixture to generate the ultrafine particles; and allowing the resultant ultrafine particles to come into contact with the reactive gas so as to produce the ultrafine particles whose surfaces are coated with the thin film including one or more components derived from decomposition and/or reaction of the reactive gas.

2. The process for producing ultrafine particles according to claim 1, wherein said step of introducing the materials for producing the ultrafine particles into the thermal plasma flame comprises:

a step of dispersing the materials for producing the ultrafine particles with a carrier gas; and a step of introducing the dispersed materials for producing the ultrafine particles into the thermal plasma flame.

3. The process for producing ultrafine particles according to claim 2, wherein particle size of said ultrafine particles is controlled by changing the supply amount of at least one of the reactive gas, the carrier gas and the cooling gas.

4. The process for producing ultrafine particles according to claim 2, wherein a thickness of the thin film to be coated on the surfaces of the ultrafine particles is controlled by changing the supply amount of at least one of the reactive gas, the carrier gas and the cooling gas.

5. The process for producing ultrafine particles according to claim 2, wherein the reactive gas is a hydrocarbon gas, the carrier gas is an inert gas and the thin film to be coated on the surfaces of the ultrafine particles is a thin film that includes an elementary carbon substance and/or a carbon compound.

6. The process for producing ultrafine particles according to claim 1, wherein components that constitute the materials for producing the ultrafine particles are metals, alloys, simple oxides, composite oxides, double oxides, oxide solid solutions, hydroxides, carbonate compounds, halides, sulfides, nitrides, carbides, hydrides, metal salts, or organometallic compounds that contain at least one element selected from the group consisting of elements having atomic numbers of 12, 13, 26 to 30, 46 to 50, 62, and 78 to 83.

7. The process for producing ultrafine particles according to claim 1, wherein the cooling gas is an inert gas.

8. The process for producing ultrafine particles according to claim 1, wherein particle size of said ultrafine particles is controlled by changing the supply amount of at least one of the reactive gas and the cooling gas.

9. The process for producing ultrafine particles according to claim 1, wherein a thickness of the thin film to be coated on the surfaces of the ultrafine particles is controlled by changing the supply amount of at least one of the reactive gas and the cooling gas.

10. The process for producing ultrafine particles according to claim 1, wherein the reactive gas is a hydrocarbon gas and the thin film to be coated on the surfaces of the ultrafine particles is a thin film that includes an elementary carbon substance and/or a carbon compound.

11. The process for producing ultrafine particles according to claim 1, wherein a total supply amount of the reactive gas and the cooling gas is set such that a gas introduced into a cooling chamber comprising a space for quenching the vapor-phase mixture has an average flow rate of 0.001 to 60 m/sec in the cooling chamber.

12. The process for producing ultrafine particles according to claim 11, wherein the total supply amount is such that the average flow rate becomes 0.01 to 10 m/sec.

* * * * *